United States Patent [19]

Stamper et al.

[11] Patent Number: 4,574,103

[45] Date of Patent: Mar. 4, 1986

[54] VINYL CHLORIDE POLYMER LAMINATE

[75] Inventors: Richard W. Stamper, Lambertville, Mich.; Robert C. Hultz, Toledo, Ohio

[73] Assignee: The General Tire & Rubber Company, Akron, Ohio

[21] Appl. No.: 709,009

[22] Filed: Mar. 6, 1985

Related U.S. Application Data

[62] Division of Ser. No. 518,247, Jul. 28, 1983, Pat. No. 4,515,744.

[51] Int. Cl.[4] ..... B32B 7/02

[52] U.S. Cl. ..... 428/213; 428/520; 428/702; 428/921

[58] Field of Search ..... 428/921, 520, 702, 688, 428/522, 213

[56] References Cited

U.S. PATENT DOCUMENTS

| | | | |
|---|---|---|---|
| 3,632,467 | 1/1972 | Todd et al. | 264/216 |
| 3,983,290 | 9/1976 | Elcik | 428/522 |
| 3,992,842 | 11/1976 | Haage et al. | 428/500 |
| 4,100,325 | 7/1978 | Summers | 428/520 |

FOREIGN PATENT DOCUMENTS 4102365 8/1979 Japan .

*Primary Examiner*—Edith Buffalow

[57] ABSTRACT

A laminate comprises fused adherent layers of plastisol vinyl chloride polymer resins in which a first layer contains $Sb_2O_3$ and a second layer contains $TiO_2$. The flexible laminate is useful as a roofing membrane for the roof of a building wherein the layer containing the $Sb_2O_3$ is adjacent a structural or insulation member of the roof of the building while the $TiO_2$ layer can be exposed to the elements and can protect the $Sb_2O_3$ layer from sunlight.

3 Claims, No Drawings

VINYL CHLORIDE POLYMER LAMINATE

This is a divisional application of application Ser. No. 518,247, filed on July 28, 1983, now U.S. Pat. No. 4,515,744.

This invention relates to a laminate of fused vinyl chloride polymer plastisols useful as a roofing layer or membrane.

OBJECTS

An object of this invention is to provide a laminate of fused vinyl chloride polymer plastisols useful as a roofing layer or membrane.

Another object of this invention is to provide a method of making a laminate of fused vinyl chloride polymer plastisols.

A further object of this invention is to provide a building with a roof having a membrane of a laminate of layers of fused vinyl chloride polymer plastisols.

SUMMARY OF THE INVENTION

According to the present invention, a vinyl chloride polymer plastisol is cast and gelled and then a second layer of a vinyl chloride plastisol is cast on the first layer and both are fused together to make a flexible vinyl chloride polymer laminate. One vinyl chloride polymer layer contains a minor effective amount by weight, preferably from about 2 to 8 parts by weight per 100 parts by weight of total polymer in the layer, of titanium dioxide as a pigment to improve the weatherability and resistance to sunlight of said layer. The other layer of the laminate contains a minor effective amount by weight of $Sb_2O_3$ as a fire retardant, preferably in an amount of from about 2 to 6 parts by weight per 100 parts by weight of total polymer in the layer. The $TiO_2$ containing layer protects the $Sb_2O_3$ containing layer since in sunlight $Sb_2O_3$ adversely affects PVC.

DISCUSSION OF DETAILS AND PREFERRED EMBODIMENTS

The vinyl chloride polymer is a plastisol grade vinyl chloride polymer (resin). Examples of such resins are homopolyvinyl chloride (preferred), copolymers of a major amount by weight of vinyl chloride and a minor amount by weight of vinyl acetate or a copolymer of a major amount by weight of vinyl chloride and a minor amount by weight of maleic ester and so forth. Mixtures of vinyl chloride plastisol polymers may be used.

Vinyl chloride polymer plastisol blending or extender resins, also, are used in the plastisol compositions in a minor amount by weight as compared to the plastisol resin itself.

The amount of plasticizer used in the compositions may amount from about 50 to 80 parts by weight per 100 parts by weight of total vinyl chloride polymer resin. Examples of plasticizers which may be used are butyl octyl phthalate, dioctyl phthalate, hexyl decyl phthalate (preferred), dihexyl phthalate, diisooctyl phthalate, dicapryl phthalate, di-n-hexyl azelate, diisononyl phthalate, dioctyl adipate, diactyl sebacate, trioctyl trimellitate, triisooctyl trimellitate, triisononyl trimellitate, isodecyl diphenyl phosphate (preferred), tricresyl phosphate, cresyl diphenyl phosphate, polymeric plasticizers, epoxidized soybean oil (preferred), octyl epoxy tallate, isooctyl epoxy tallate and so forth. Mixtures of plasticizers may be used.

Other plastisol compounding ingredients are desirably incorporated in the plastisol compositions. Examples of such ingredients are the silicas such as precipitated silica, fumed colloidal silica, calcium silicate and the like, calcium carbonate, ultra violet light absorbers, fungicides, carbon black, barytes, barium-cadmium-zinc stabilizers, barium-cadmium stabilizers, tin stabilizers, dibasic lead phosphite and so forth and mixtures of the same. Preferred pigments to use are carbon black, fumed colloidal silica and calcium carbonate. $TiO_2$, also, can be used in the bottom layer. The pigments and the other dry additives preferably are dispensed or dissolved in one or more plasticizers before adding to the plastisol compositions. These pigments are used in effective amounts by weight to control color, mildew, stabilization, viscosity and so forth.

The ingredients forming the plastisol composition may be charged to and mixed together in any one of several mixing devices such as a Ross Planetary mixer, Hobart dough type mixer, Nauta mixer and so forth.

In preparing the laminate the vinyl chloride polymer plastisol composition containing the $Sb_2O_3$ and other compounding ingredients is cast or reverse coated on release paper or other release surface and spread evenly to the desired gauge by a doctor blade or metering roll to form a coating or film which is then passed through an oven and heated at a temperature of from about 170° to 250° F. for a period of time sufficient to gel said plastisol layer. Next, a second layer of a vinyl chloride polymer plastisol composition containing $TiO_2$ is cast or reverse roller coated on said first layer and spread evenly to the desired gauge by means of a doctor blade and the combined layers are then passed through an oven and heated at a temperature of from about 250° to 400° F. for from about one to five minutes to effect fusion of both layers and adherence of both layers to each other. The laminate is then cooled, separated from the release paper and wound up on a take-off roll. Each layer of the laminate has a thickness of from about 12 mils to 50 mils, so that overall the laminate has a total thickness of from about 24 to 100 mils. While it is preferred to deposit and gel the plastisol composition containing the $Sb_2O_3$ first, this is unnecessary as the plastisol composition containing the $TiO_2$ can first be cast and gelled after which the plastisol composition containing the $Sb_2O_3$ can be cast on it and both fused together. Additional plastisol layers can be deposited if desired.

For more information on vinyl chloride polymers and copolymers (resins), plastisols, plasticizers, compounding ingredients and so forth, please see Schildknecht, "Vinyl and Related Polymers," John Wiley & Sons, Inc., New York, 1952; Sarvetnick, "Polyvinyl Chloride," Van Nostrand Reinhold Company, New York, 1969; Sarvetnick, "Plastisols And Organosols," Van Nostrand Reinhold Company, New York, 1972 and "Modern Plastics Encyclopedia 1980–1981," October, 1980, Volume 57, No. 10A, McGraw-Hill Inc., New York.

The resulting fused plastisol laminate is used as a roofing layer or membrane on the roof of a building. The flexible laminate is placed on the surface of wood, concrete, insulation or other structural material or member of the roof of a building with the layer containing the $Sb_2O_3$ adjacent or on top of the wood, concrete or other insulation or structural material or member of the roof. Thus, the $TiO_2$ containing layer is exposed to the elements. While the laminate is particularly useful as a roofing membrane, it also can be employed in the manufacture of wall coverings, tarpaulins, tents, inflatable life rafts and so forth. Also, the substrate need not be a release paper but can be a woven or non-woven fabric where the laminate of fused plastisols is to be used in applications other than as a roofing membrane.

We claim:

1. A laminate comprising (A.) a first layer having a thickness of from about 12 to 50 mils, being of a compounded and stabilized vinyl chloride polymer plastisol composition containing antimony trioxide and being free of a curing agent and (B.) a second layer on said first layer having a thickness of from about 12 to 50 mils, being of a compounded and stabilized vinyl chloride polymer plastisol composition containing titanium dioxide and being free of a curing agent, said layers having been heated at a temperature of from about 250° to 400° F. for from about one to five minutes to fuse said layers and to adhere said layers together to obtain a flexible vinyl chloride polymer laminate.

2. The laminate according to claim 1 in which each of said layers (A.) and (B.) the vinyl chloride polymer is homopolyvinyl chloride, in which in each of said layers (A.) and (B.) the amount of plasticizer is from about 50 to 80 parts by weight per 100 parts by weight total of vinyl chloride polymer, wherein said antimony trioxide is used in an amount of from about 2 to 6 parts by weight per 100 parts by weight of the total vinyl chloride polymer in (A.) and wherein said titanium dioxide is used in an amount of from about 2 to 6 parts by weight per 100 parts by weight of the total vinyl chloride polymer in (B.).

3. The laminate according to claim 2 wherein each layer contains effective amounts by weight of carbon black, fumed colloidal silica and calcium carbonate.

* * * * *

UNITED STATES PATENT AND TRADEMARK OFFICE

CERTIFICATE OF CORRECTION

PATENT NO. : 4,574,103

DATED : March 4, 1986

INVENTOR(S) : Richard W. Stamper et al

It is certified that error appears in the above-identified patent and that said Letters Patent are hereby corrected as shown below:

Column 4, line 12, change "6" to ---8---.

Signed and Sealed this

*Tenth* Day of *June 1986*

[SEAL]

*Attest:*

DONALD J. QUIGG

*Attesting Officer*

*Commissioner of Patents and Trademarks*